United States Patent [19]

Martin et al.

[11] 4,165,206

[45] Aug. 21, 1979

[54] THREE GEAR PUMP WITH MODULE CONSTRUCTION

[75] Inventors: Thomas B. Martin, Pleasant Hill; Ferdinandus A. Pieters, Walnut Creek, both of Calif.

[73] Assignee: Micropump Corporation, Concord, Calif.

[21] Appl. No.: 804,766

[22] Filed: Jun. 8, 1977

Related U.S. Application Data

[63] Continuation-in-part of Ser. No. 763,523, Jan. 28, 1977, Pat. No. 4,127,365.

[51] Int. Cl.[2] ..... F04C 1/08; F04C 15/00; F04B 49/02; F04B 35/00

[52] U.S. Cl. ..... 417/310; 417/420; 418/126; 418/129; 418/135; 418/196

[58] Field of Search ..... 418/131, 132, 135, 126, 418/129, 165, 196, 206; 417/310, 420

[56] References Cited

U.S. PATENT DOCUMENTS

| | | | |
|---|---|---|---|
| 2,399,008 | 4/1946 | Doran | 418/165 |
| 2,471,915 | 5/1949 | Thacher | 418/206 |
| 2,589,528 | 3/1952 | Bergsma | 418/196 |
| 2,796,031 | 6/1957 | Miller | 418/126 |
| 2,817,297 | 12/1957 | Mosbacher | 418/126 |
| 2,915,976 | 12/1959 | Demtchenko | 418/196 |
| 2,921,530 | 1/1960 | Aumick | 417/310 |
| 3,128,710 | 4/1964 | Blomgren et al. | 417/310 |
| 3,133,506 | 5/1964 | Luciani | 418/206 |
| 3,376,824 | 4/1968 | Turolla | 418/132 |
| 3,427,985 | 2/1969 | Difford | 418/196 |
| 3,802,804 | 4/1974 | Zimmermann | 417/420 |

FOREIGN PATENT DOCUMENTS

| | | | |
|---|---|---|---|
| 2138635 | 2/1972 | Fed. Rep. of Germany | 418/196 |
| 1728462 | 1/1973 | Fed. Rep. of Germany | 417/420 |

*Primary Examiner*—John J. Vrablik
*Attorney, Agent, or Firm*—Julian Caplan

[57] ABSTRACT

A module pump comprises a manifold having intake and outlet connections; a plate to which gears and a "shoe" (which function to define pump chambers for a pair of gears) or, in a pump having three gears two "shoes;" a drive for the gears, which in a preferred embodiment is a magnetic drive; and a barrier between the drive and the plate. Each of the modules is subject to variations in design depending upon end use and hence wide versatility is achieved without great increases in manufacturing cost since only one of the modules need be altered. Use of three gears doubles the capacity of the pump; if three gears are not needed the mounting holes for the third gear may be plugged. A unique bypass is installed in the manifold to permit flow back to the intake when the pressure exceeds an adjustable amount.

17 Claims, 15 Drawing Figures

THREE GEAR PUMP WITH MODULE CONSTRUCTION

This invention relates to a new and improved gear pump with module construction and preferably having more than two gears.

A feature of the present invention is the fact that the pump consists of several modules, specifically a manifold corresponding to a pump body with connections to intake and outlet lines and having on one face a pair of inlet ports (if more than two gears are used) a discharge port and, preferably, a bypass Adjacent the manifold and separated therefrom by a gasket is a module plate on which are mounted gears and one or more "shoes." The shoes fit over the mesh points of a pair of gears and fit around the inlet duct and thus isolate this area from the pump cavity to establish a pump chamber within the pump cavity. Such shoes are described in detail in Ser. No. 763,523. Various means may be used to drive the pump and hence a drive module is provided which drives one of the gears mounted on the plate module. In a preferred embodiment of the invention, the drive is a magnetic drive, the driven magnet being separated from the exterior by a cup or barrier which encloses the plate module and seals against its gasket.

An advantage of the modular construction is the fact that the modular plate, its gears and shoes are relatively compact as compared with a normal gear pump. Further, all of the variable features of the pump are mounted for practical purposes on this plate. A variety of different structures may be incorporated on either side of the manifold plate depending upon the customers' equipment needs.

Further advantage of the module construction is the fact that the pump is easily manufactured. Further, each section of the pump can be checked for performance before being built into the unit.

A further feature of the construction is that by use of a plane of separation between the manifold and the plate provision may be made for cross channels from one inlet port to the other where more than two gears are used.

A further feature of the invention is the fact that by merely loosening certain screws which hold the parts assembled, the manifold and piping, etc. connected to it may be turned relative to the remainder of the pump through any desired degree.

One of the features of the invention is a simple bypass. The valve for this bypass seats against the module plate and there are bypass passages through the gaskets between the manifold and the module plate through which the overflow of the bypass circulates back to the intake.

A still further feature of the modular construction is the fact that different materials may be used in the various parts of the pump depending upon the function of the part and considerations of economy.

As hereinafter described, the preferred embodiment of the invention uses three gears mounted on the modular plate and this doubles the capacity of a pump of given size. A further feature of this construction is the symmetry of construction. The forces are balanced on the center gear and hence the design considerations do not concern the bearing load but merely the drive.

As has been stated, if desired, only two gears may be used and the holes for the mounting and intake of the third gear may be plugged. Use of a three gear pump makes it possible to use a four pole induction motor and achieve the same rate of flow as a two gear pump with a two pole motor. Use of a four pole motor is preferable since it runs at half the speed of a two pole motor and hence noise and vibration are reduced.

As has been stated, this invention is a continuation-in-part of Ser. No. 763,523 and many of the advantages of that application are achieved in the present construction. The advantages of the use of "shoes" for example, are not repeated herein but reference is made to the foregoing application.

Other objects of the present invention will become apparent upon reading the following specification and referring to the accompanying drawings in which similar characters of reference represent corresponding parts in each of the several views.

Figure 1:
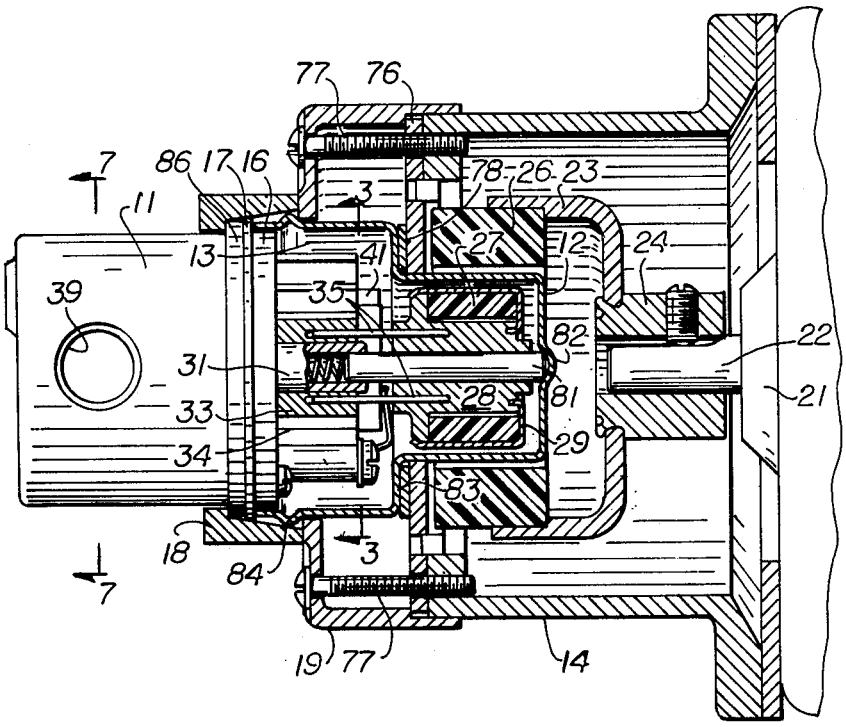
FIG. 1 is a vertical sectional view through a pump in accordance with the present invention.
Figure 2:
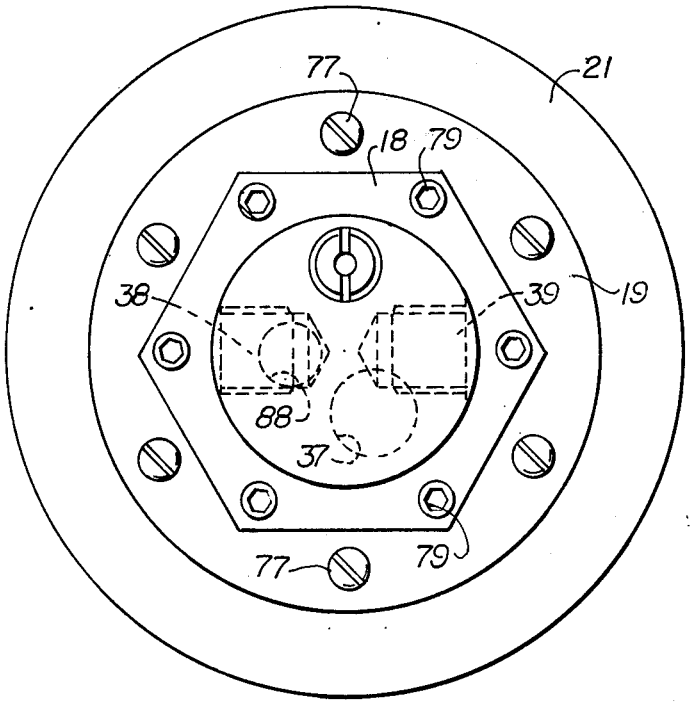
FIG. 2 is an end view from the left of FIG. 1.

One of the features of the invention is a modular construction of the pump. As best shown in FIGS. 1 and 2, a manifold 11 is provided which corresponds roughly to a pump body in a conventional pump. Along the inner face of manifold 11 is a modular disk 16 separated from the adjacent face of the manifold 11 by a gasket 17. The foregoing portions of the pump are mounted on an angular bracket 14 which may be fixed in any of various manners to the casing of a motor 21. Motor 21 has a shaft 22 connected to a cup shaped magnet flange 23 through a hub 24. An annular drive magnet 26 is fixed to the cup 23. Magnet 23 drives the driven magnet 27 mounted in a magnet holder 28 and retained therein by retainer 29. Magnet holder 28 rotates about the stationary mounting pin 81. To separate drive magnet 26 from driven magnet 27 there is a non-magnetic cup 12. A dimple 82 is formed in the bottom of cup 12 and forms a seat for the outer end of pin 81. Cup 12 also has a shoulder 83 and adjacent its open end an outward extending rib 84.

Assembly of the parts is accomplished by the use of a clamping ring 18 which is annular and fits against a shoulder like flange 86 on the inner end of manifold 11. By screws 79 the clamping ring 18 is attached to an annular flange 19 which is attached by screws 77 to the annular bracket 14 of motor 21. An apertured disk 76 fits against the outer edge of bracket 14. A resilient washer 78 is interposed between disk 76 and the shoulder 83 of cup 13. Hence when the screws 79 are tightened, the cup 12 is biased toward the left as viewed in FIG. 1, causing the rim of the cup to firmly engage the gasket 17 and define a pump cavity 13 inside cup 12 and to the right of gasket 17 as viewed in FIG. 1. Rib 84 on cup 12 bears against the flange 19. For such purpose, as screws 79 are tightened they bring the clamping ring 18 against the flange 86 of manifold 11.

Figure 4:
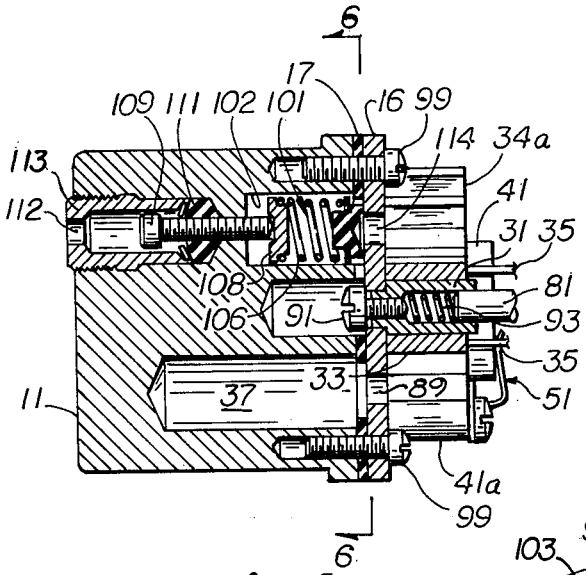
FIG. 4 is a sectional view taken substantially along the line 4—4 of FIG. 3.
Figure 8:
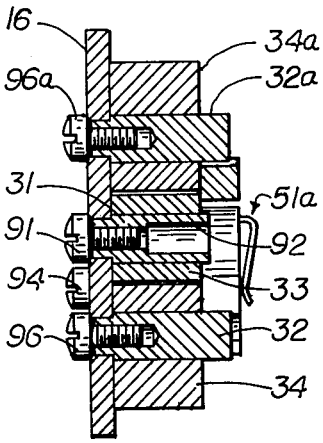
FIG. 8 is a sectional view taken substantially along the line 8—8 of FIG. 3.

Directing attention to FIGS. 4 and 8, mounted centrally in a hole in module plate 16 is hollow shaft 31 held in place by screw 91 and having a bore 92 in which is a spring 93 which bears against the end of magnet mounting pin 81 and biases the pin against the dimple 82. Rotatable about hollow shaft 31 is the drive gear 33. A preferred means for driving gear 33 is a plurality of drive pins 35 which fit into holes in drive gear 33 and into corresponding holes in magnet holder 28, the pins 35 being parallel to shaft 31 and pin 81. Hence as the motor shaft 22 turns, magnet 26 causes magnet 27 to turn and this through pins 35 causes the drive gear 33 to rotate about hollow shaft 31.

In the preferred embodiment illustrated herein there are three gears on the pump. Use of the third gear is optional and for sake of simplicity, the pump will first be described with reference only to one driven gear. Directing attention now to FIG. 8, driven gear shaft 32 is mounted on plate 16 by screw 96. Driven gear 34 is rotatable about shaft 32 and meshes with gear 33.

Figure 6:
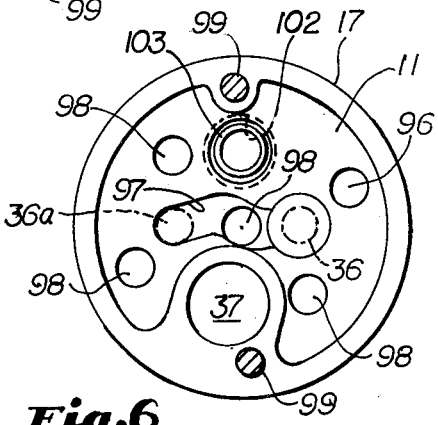
FIG. 6 is a view taken substantially along the line 6—6 of FIG. 4.
Figure 7:
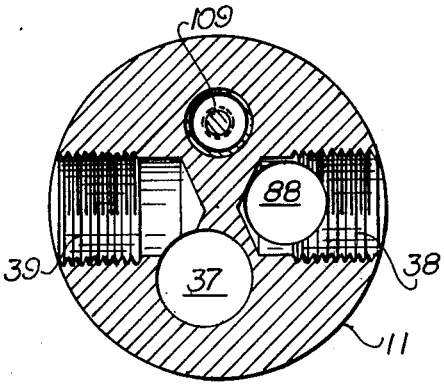
FIG. 7 is a view taken substantially along the line 7—7 of FIG. 1.
Figure 11:
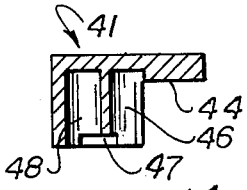
FIG. 11 is a sectional view taken substantially along the line 11—11 of FIG. 9.

As shown in FIGS. 6 and 7, inlet duct 36 is formed in plate 16 and communicates with longitudinal inlet duct 88 in manifold 21 which in turn communicates with inlet port 38 which is connected by any convenient means with the piping for the pump. Also formed in manifold 11 is a pump discharge duct 37 which communicates with outlet port 39. Discharge port 89 in plate 13 is on the opposite side of the mesh point of gears 33, 34 from inlet point 36. Hence as the gears 33, 34 rotate, fluid is forced from duct 36 out discharge port 89.

Figure 3:
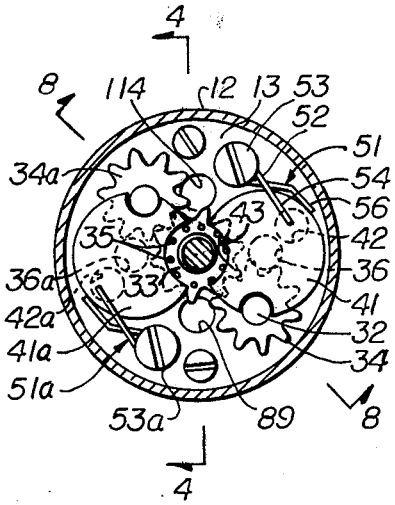
FIG. 3 is a sectional view taken substantially along the line 3—3 of FIG. 1.

In order to establish a pump chamber within the pump cavity 13, a shoe 41 is located in cavity 13 which covers both the opening of inlet duct 36 and the mesh point of the gears 33, 34 and approximately two teeth on either side of the mesh point in order to form a seal with the tips of one or more teeth. Shoe 41 is supported by a pin 42 held in plate 16 by screw 94, pin 42 being parallel to shafts 31, 32. A notch 43 is cut in the edge of shoe 41 for clearance of pins 35. (See FIG. 3). A recess 44 is formed in the underside of shoe 41 for a clearance of gears 33, 34 which fit into said recess (see FIGS. 9—10). A deeper recess 46 is formed directly opposite inlet duct 36 and hence fluid entering through duct 36 enters recess 46 and then passes into the recess 44 at the mesh point of the gears. The bore 43 receives pin 42 which supports shoe 41. An elongated, very shallow recess 47 is located between the recesses 46 and 48. Recess 49 provides clearance for the end of shaft 32.

When the pump is running, the pressure within the cavity 13 is the discharge pressure, while the pressure in duct 36 is the inlet pressure. This pressure differential forces the shoe 41 against the face of plate 16 and against the tips of the gears 33, 34. Recess 47, which is connected to recess 46, insures that such inlet pressure exists over the face of side 41 which is in contact with plate 16. However, when the pump is started, spring 51 is used to hold the shoe 41 in place until the pressure differential takes over. Spring 51 is formed with an eye 52 at its mid point. A screw 53 passes through eye 52, is threaded into the plate 16, and holds spring 51. One leg 54 of spring 51 overlies the outer face of shoe 41 and the other leg 56, which is bent in a dog-leg, biases the edge of shoe 41 toward the mesh point of gears 33, 34.

As previously stated, in a preferred embodiment of this invention there are three gears. The third gear **34*a* is rotatably mounted on a shaft 32*a* held in plate 16 by screw 96*a*. A second inlet 36*a* is formed in plate 16 180° opposite inlet 36. A second shoe 41*a* similar in all respects to the shoe 41 covers the mesh points of gears 33, 34*a* and inlet 36*a* and is held in place before pump pressure takes over by the spring 51*a* held in place by screw 53*a*. In most respects the gear 34*a* resembles the gear 34 and the shoe 41*a* resembles the shoe 41 and the spring 51*a* resembles the spring 51** and the same reference numerals followed by the subscript a are used to designate corresponding parts throughout.

Directing attention now to FIG. 6 it will be seen that the shape of gasket 17 is such that it seals the discharge outlet 37 against the plate 16 but that in other respects there is free communication between the various ports. Holes 98 are formed in the face of manifold 11 to receive the heads of the screws 91, 94, 96 and **96*a*. An irregularly shaped channel 97 is recessed into the face of manifold 11 establishing communication between the points opposite the hole 36 and 36*a* in plate 16. Screw 99 holds plate 16 and gasket 17 in place against manifold 11. A bypass 101 is provided when the pressure within the pump cavity 13 exceeds a predetermined amount. For this purpose a recess 102 is formed in the face of manifold 11. Fitting within the recess 102 is a poppet 103 having a rim 104 which seals around the discharge opening 114 in plate 16 when the poppet 103 is seated. Poppet 103 is biased toward seated position by spring 106 in recess 102 which bears against a washer 107 which is fitted into the poppet 103. On the opposite end of spring 106 is a spring abutment 108 which is free within the recess 102 and whose position is adjusted by screw 102 threaded into the manifold 11. A gland 111 seals the leakage of fluid from the hole for screw 109 and is tightened by turning gland tightening sleeve 113 threaded into a hole in manifold 11. An opening 112 is formed in the gland tightening sleeve 113 so that an adjustment of the position of screw 109** may be made.

Figure 5:
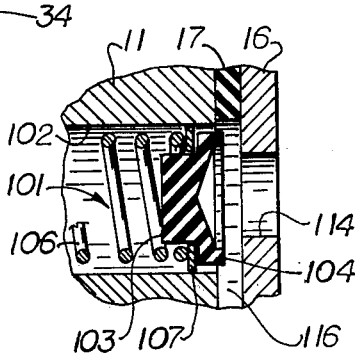
FIG. 5 is an enlarged fragmentary view of the bypass construction.
Figure 9:
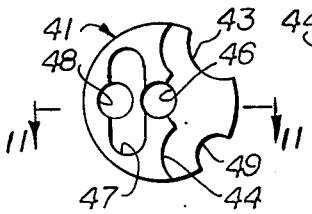
FIG. 9 is an elevational view of the back of one of the shoes used with the present invention.
Figure 10:
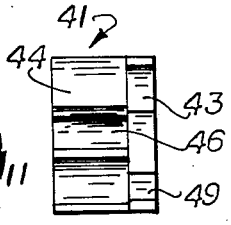
FIG. 10 is a side elevational view from the right of FIG. 9.

Directing attention now to FIG. 5, when the pressure within the cavity 13 exceeds the pressure established by the position of the adjustment screw 109 the poppet 103 unseats (as shown in FIG. 9) and hence fluid may flow from the cavity 13 through the bypass opening 114 and thence through the space 116 between plate 16 and manifold 11 and back to the intake openings 36 and **36*a***.

Figure 12:
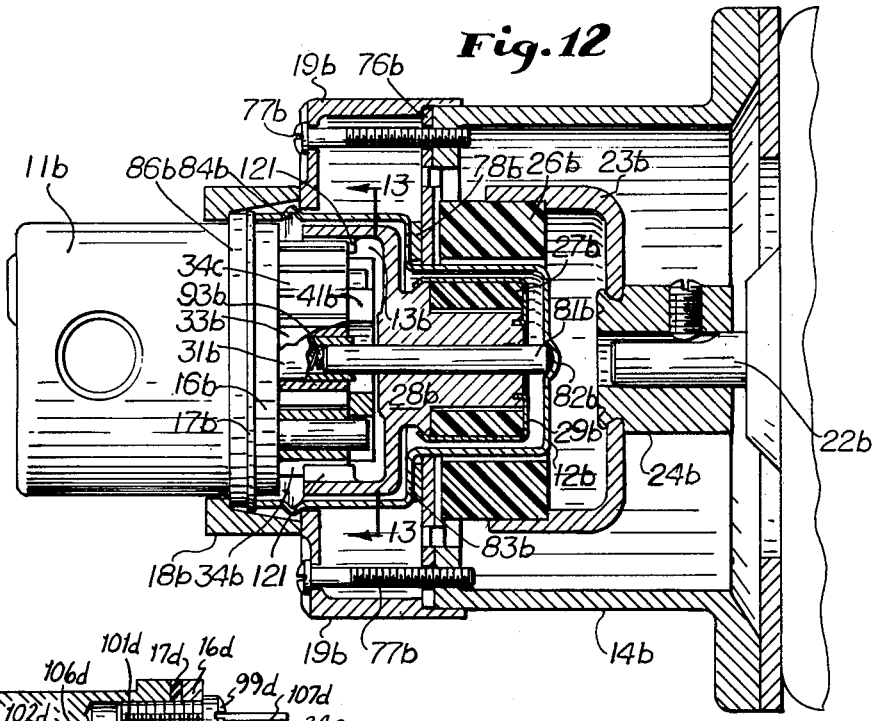
FIG. 12 is a view similar to FIG. 1 showing a modification of the pump gear system of this invention.
Figure 15:
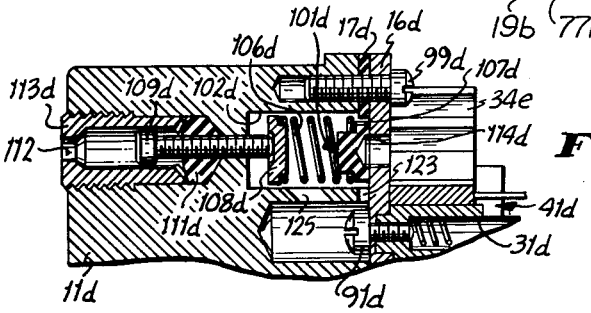
FIG. 15 is a fragmentary sectional view of a portion of the structure of FIG. 14 taken substantially along the line 15—15 of FIG. 14.
Figure 13:
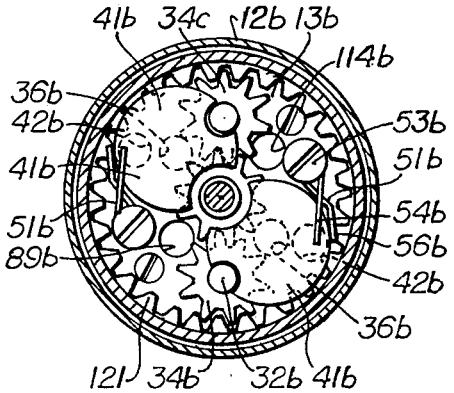
FIG. 13 is a section view taken substantially along the line 13—13 of FIG. 12.

A modification of the gear pump system of the modular pump of this invention is shown in FIGS. 12 and 13 where internal ring gear 121 is formed on cup 120 which is an extension of magnet holder 286. Internal gear 121 meshes with pump gears **34*b* and 34*c* at the outer periphery of the pump where the teeth of gears are unencumbered by other parts, such as the shoes. The use of internal gear 121** may provide a speed up ratio to the pump gears of substantially 3 to 1, relative to shaft 22*b* of driving motor 21*b*, thereby significantly increasing the output of a given pump.

Figure 14:
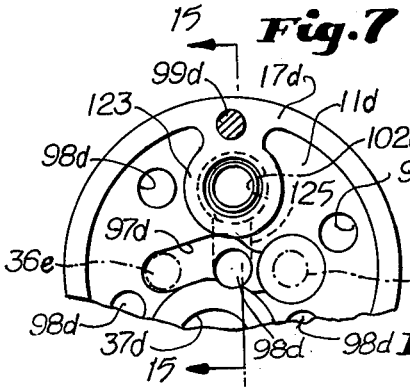
FIG. 14 is a fragmentary view similar to a portion of FIG. 6 showing a modified gasket.

Referring to FIG. 14, gasket 17*d* has portion 123 which seals bypass discharge opening 114*d* against plate 16*d* to prevent communication between it and the various inlet ports. A bypass passage 125 connects recess 102*d* at a point on the side of washer 107*d* away from the plate 16*d* with channel 97*d* such that when fluid flows from cavity 13*d* (as shown in FIG. 1) through opening 114*d* it must pass by the restriction imposed by washer 107*d* in recess 102*d* and thence through channel 97*d* via passage 125 to the pump inlet. This modification allows an increase in force against spring 106*d* leading to improved operating characteristics of the bypass.

In other respects the modifications of FIGS. 12 and 13 and FIG. 14 resemble the form of invention shown in FIGS. 1–11, and the same reference numerals followed by subscripts b and d, respectively, designate corresponding parts.

What is claimed is:

1. A pump comprising a manifold having a parting surface formed with a discharge duct and an inlet duct and outlet and inlet ports, respectively, from the exterior of said manifold to said ducts, a modular plate having first and second faces, said first face being parallel to and communicating with said parting surface, at least one plate inlet port in said plate communicating with said inlet duct and a plate discharge port communicating with said discharge duct, a first gear, a first gear shaft fixed to and supported by said modular plate and mounting said first gear rotatable against said second face, a second gear meshing with said first gear, second gear mounting means fixed to and supported by said modular plate, said manifold being discrete from said first and second gear mounting means, said plate inlet and discharge ports being on opposite sides of the mesh point on said gears, pump chamber defining means sealing relative to said modular plate to enclose a space outward of said second face which includes said plate inlet port and at least that portion of said first and second gears that includes said mesh point and at least two teeth of each gear to either side of said mesh point, and drive means for rotating one of said gears, said pump chamber defining means comprising an imperforate shoe mounted on said modular plate overlying said plate inlet port and a portion of said gears opposite said modular plate to either side of said mesh point, said shoe mounted on said modular plate comprising a disk formed with a first recess for rotation of said gears and a second recess communicating with said first recess and with said plate inlet port.

2. A pump according to claim 1 in which said drive means comprises an internal ring gear meshing with said one gear and means for rotating said ring gear.

3. A pump according to claim 1 which further comprises a spring mounted on said modular plate biasing said shoe into close contact with said surfaces of said gears opposite said modular plate.

4. A pump according to claim 1 which further comprises a cup, and seal means sealing the rim of said cup to said modular plate, said cup and said modular plate defining a pump cavity.

5. A pump according to claim 4 which further comprises a driven magnet within said pump cavity, means on said modular plate rotatably mounting said driven magnet, a drive magnet outside said pump cavity concentric with said driven magnet and a motor to turn said drive magnet.

6. A pump according to claim 4 in which said means for driving one of said gears comprises a pair of magnets, one said magnet being connected to be turned by a motor, the other said magnet being connected to turn said one gear, said magnets being on opposite sides of said means defining a pump cavity.

7. A pump according to claim 4 which further comprises a resilient gasket between said parting surface and said modular plate, said cup having a rim sealing against said gasket.

8. A pump according to claim 7 which further comprises clamp means clamping said manifold and said modular plate together with said gasket interposed there-between and clamping said rim to said gasket.

9. A pump according to claim 1 which further comprises a third gear meshing with said first gear at a second mesh point remote from said first-mentioned mesh point, third gear mounting means fixed to and supported by said modular plate, a second inlet port in said plate communicating with said inlet duct, a second pump chamber defining means separate from said first-mentioned pump chamber defining means sealing relative to said modular plate to enclose a second space outward of said second face which includes said second plate inlet port and at least that portion of said first and third gears that includes said second mesh point and at least two teeth of said last-mentioned gears to either side of said second mesh point.

10. A pump according to claim 9 in which said drive means comprises an internal ring gear meshing with said second and third gears and means for rotating said ring gear.

11. A pump according to claim 9 in which said second pump chamber defining means comprises a second shoe mounted on said modular plate overlying said second plate inlet port and portions of said first and third gears opposite said modular plate to either side of said second mesh point.

12. A pump according to claim 1 in which said manifold is formed with a bypass recess inward of said parting surface and said modular plate is formed with a bypass opening and which further comprises means defining a pump cavity around said second surface and enclosing said plate inlet and discharge ports and said pump chamber defining means and said first and second gears, valve means in said bypass recess having a first position sealing against said modular plate around said bypass opening and a second position unseated from said modular plate and resilient means biasing said valve means toward first position until the discharge pressure in said pump cavity exceeds a predetermined pressure, said bypass recess communicating said bypass opening with said plate inlet port whereby overflow through said bypass opening circulates back to said plate inlet port.

13. A pump according to claim 12 which further comprises adjustment means for adjusting said resilient means, said adjustment means being operable from the exterior of said pump.

14. A pump according to claim 12 which further comprises seal means sealing said manifold to said modular plate, said seal means comprising a portion surrounding said bypass recess.

15. A pump according to claim 1 in which said drive means comprises an internal ring gear meshing said second and third gears and means for rotating said ring gear.

16. A pump according to claim 15 in which each of said means for defining two separate pump cavities comprises a shoe overlying the mesh point of said first gear and one of said second and third gears and one of said inlet openings and means for mounting said shoe to seal against the sides of said first and one of said second and third gears and said parting face.

17. A pump according to claim 15 which further comprises a plate, means sealing said plate to said parting face, said means mounting said gears being fixed to and supported by said plate, said plate being removable from said manifold.

* * * * *